US009966710B2

(12) United States Patent
Chen et al.

(10) Patent No.: US 9,966,710 B2
(45) Date of Patent: May 8, 2018

(54) ELECTRICAL PLUG CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Xiao-Juan Qi, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days. days.

(21) Appl. No.: 15/259,716

(22) Filed: Sep. 8, 2016

(65) Prior Publication Data

US 2017/0070015 A1 Mar. 9, 2017

(30) Foreign Application Priority Data

Sep. 9, 2015 (CN) ..... 2015 1 0568794

(51) Int. Cl.

| | |
|---|---|
| ***H01R 24/60*** | (2011.01) |
| ***H01R 13/502*** | (2006.01) |
| ***H01R 13/6581*** | (2011.01) |
| ***H01R 13/6585*** | (2011.01) |
| *H01R 107/00* | (2006.01) |

(52) U.S. Cl.

CPC ..... *H01R 24/60* (2013.01); *H01R 13/502* (2013.01); *H01R 13/6581* (2013.01); *H01R 13/6585* (2013.01); *H01R 2107/00* (2013.01)

(58) Field of Classification Search

CPC H01R 13/6585; H01R 24/60; H01R 2107/00; H01R 13/6581

See application file for complete search history.

(56) References Cited

U.S. PATENT DOCUMENTS

| | | | | |
|---|---|---|---|---|
| 9,455,535 | B1 * | 9/2016 | Chiang | H01R 13/6585 |
| 2015/0288107 | A1 * | 10/2015 | Wu | H01R 13/6593 439/357 |
| 2015/0303623 | A1 * | 10/2015 | Kao | H01R 13/6583 439/607.04 |
| 2016/0020569 | A1 * | 1/2016 | Ju | H01R 24/78 439/607.01 |
| 2016/0064864 | A1 * | 3/2016 | Kao | H01R 13/6461 439/607.05 |

(Continued)

*Primary Examiner* — James Harvey

*Assistant Examiner* — Oscar Jimenez

(74) *Attorney, Agent, or Firm* — Muncy, Geissler, Olds & Lowe, P.C.

(57) ABSTRACT

An electrical plug connector includes an insulated housing, first terminals, second terminals, a shielding plate, and two side arms. The insulated housing includes first and second assembling surfaces, an insertion cavity, and an insertion opening. The first and the assembling surfaces respectively include first and second hot-melt regions. The insertion cavity is extending from the end of the insulated housing opposite to the insertion opening toward an interior of the insulated housing. The insertion cavity is between the first and the second assembling surfaces. A portion of each of the first terminals and a portion of each of the second terminals are respectively in the first and the second hot-melt regions. The shielding plate is in the insertion cavity and fixed with the insulated housing. The side arms are respectively connected to two ends of the shielding plate and on two sides of the insertion cavity.

30 Claims, 8 Drawing Sheets

(56) References Cited

U.S. PATENT DOCUMENTS

| | | | | |
|---|---|---|---|---|
| 2016/0072242 | A1* | 3/2016 | Yu | H01R 24/70<br>439/95 |
| 2016/0156136 | A1* | 6/2016 | Kao | H01R 13/6585<br>439/607.05 |
| 2016/0240983 | A1* | 8/2016 | Yu | H01R 13/6583 |

* cited by examiner

1

ELECTRICAL PLUG CONNECTOR

CROSS-REFERENCES TO RELATED APPLICATIONS

This non-provisional application claims priority under 35 U.S.C. § 119(a) on Patent Application No. 201510568794.6 filed in China, P.R.C. on Sep. 9, 2015, the entire contents of which are hereby incorporated by reference.

FIELD OF THE INVENTION

The instant disclosure relates to an electrical connector, and more particular to a USB electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.1, are developed, which may provide a higher transmission rate, e.g., 10 Gbs, so as to satisfy the need of a variety devices.

The opening of the USB 3.1 connector is thin and small so as to be conformed with the specification of the product. Commonly, the USB interfaces are widely utilized for the interfaces of high frequency, radiofrequency, wireless, or Bluetooth emitters. Because of the high transmission rate of the USB 3.1 interface, the performance of the product having the USB 3.1 interface can be affected by either external electromagnetic interferences or internal signal crosstalk between terminals. Shielding elements are provided for the connector to address these issues; nevertheless, the difficulties in both the manufacture and the assembly of the connector are increased due to a great number of the pieces the connector has. In addition, the connector needs to have some openings so that fixtures can insert into the openings for positioning the connector. Hence, the structural strength of the connector would be reduced and further the defect free rate of the connector is. Upon a connector is damaged, not only the motherboard has to be detached from the connector for replacement, but also the connector itself has to be replaced. Therefore, the cost for the repair of the connector is expensive.

SUMMARY OF THE INVENTION

Therefore, how to provide a plug connector having increased structural strength and shielding performance and having simplified structure, reduced manufacturing steps, reduced complexity in assembly, and improved defect-free rate is an issue.

In view of this, an embodiment of the instant disclosure provides an electrical plug connector. The electrical receptacle connector comprises an insulated housing, a plurality of first terminals, a plurality of second terminals, a shielding plate, and two side arms. The insulated housing comprises a first assembling surface, a second assembling surface, an insertion cavity, and an insertion opening. The first assembling surface comprises a first hot-melt region. The second assembling surface comprises a second hot-melt region. The insertion opening is on one of two end of the insulated housing. The insertion cavity is extending from an end of the insulated housing opposed to the insertion opening toward an interior of the insulated housing. The insertion cavity is between the first assembling surface and the second assembling surface. The first terminals are on an inner surface of the first assembling surface. A portion of each of the first terminals is in the first hot-melt region. The second terminals are on an inner surface of the second assembling surface. A portion of each of the second terminals is in the second hot-melt region. The shielding plate is in the insertion cavity and fixed with the insulated housing. The two side arms are respectively connected to two ends of the shielding plate and on two sides of the insertion cavity. Each of the side arms comprises an elastic buckling portion, and the two elastic buckling portions face each other. Accordingly, when the electrical plug connector is mated with an electrical receptacle connector, the elastic buckling portions of the side arms are in contact with the electrical receptacle connector.

In one embodiment, the shielding plate and the two side arms are integrally formed with each other to form a shielding connection plate.

In one embodiment, the first assembling surface comprises a first opening, the second assembling surface comprises a second opening, and the shielding plate comprises a third opening. The first opening and the second opening correspond to the third opening. The first opening, the second opening, and the third opening are in communication with each other. In one embodiment, the first terminals, the second terminals, the shielding plate, and the side arms are assembled with the insulated housing by inserting molding. The first opening, the second opening, and the third opening are sealed by plastic materials or glues during inserting molding.

In one embodiment, each of the first terminals comprises a first flexible contact portion and a first tail portion extending from one end of the first flexible contact portion, and each of the second terminals comprises a second flexible contact portion and a second tail portion extending from one end of the second flexible contact portion. The first tail portions and the second tail portions are protruding from the insulated housing. Furthermore, the shape of each of the first terminals is the same as the shape of each of the second terminals.

In one embodiment, the electrical plug connector further comprises an outer shell assembled out of the insulated housing.

In one embodiment, the electrical plug connector further comprises a first conductive sheet and a second conductive sheet respectively held on an upper portion of the insulated housing and a lower portion of the insulated housing for shielding the first terminals and the second terminals. The first conductive sheet comprises a first contact portion, the second conductive sheet comprises a second contact portion, and the first contact portion and the second contact portion are respectively in contact with the outer shell to form a grounding loop.

In one embodiment, the electrical plug connector further comprises two soldering legs respectively connected to the side arms. Each of the soldering legs is extending from the corresponding side arm along a direction away from the shielding plate and protruding from the insulated housing.

Moreover, each of the soldering legs comprises a contact bump in contact with the outer shell.

In one embodiment, the first assembling surface and the second assembling surface further comprise a plurality of protrusions thereon, and a plurality of grooves is defined between the protrusions for positioning the first terminals and the second terminals, respectively.

In one embodiment, the elastic buckling portion of each of the side arms is a wavy shaped structure, and the wavy shaped structures of the two side arms have mirror symmetry and correspond to each other. When the electrical plug connector is mated with an electrical receptacle connector, parts of the wavy shaped structure are suspended to provide a spring force for the mating connector. Accordingly, the mating connector can be firmly mated with the electrical plug connector.

In one embodiment, the elastic buckling portion of each of the side arms comprises a protruding portion having an inclined surface. The two inclined surfaces of the two side arms form an inverse V shape with respect to an insertion direction of the insertion opening for guiding an electrical receptacle connector to be mated with the electrical plug connector properly when the electrical receptacle connector is mated with the electrical plug connector.

Based on the above, the shielding plate and the side arms can be assembled with the insertion cavity of the insulated housing. Therefore, the structure of the connector can be simplified, the structural strength of the connector can be improved, the complexity in manufacture and assembly can be reduced, and the defect-free rate of the connector can be improved. Furthermore, the connector can perform great electromagnetic shielding performance, and the electromagnetic interference and the signal crosstalk between terminals can be reduced even when the connector is provided for high frequency transmission.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
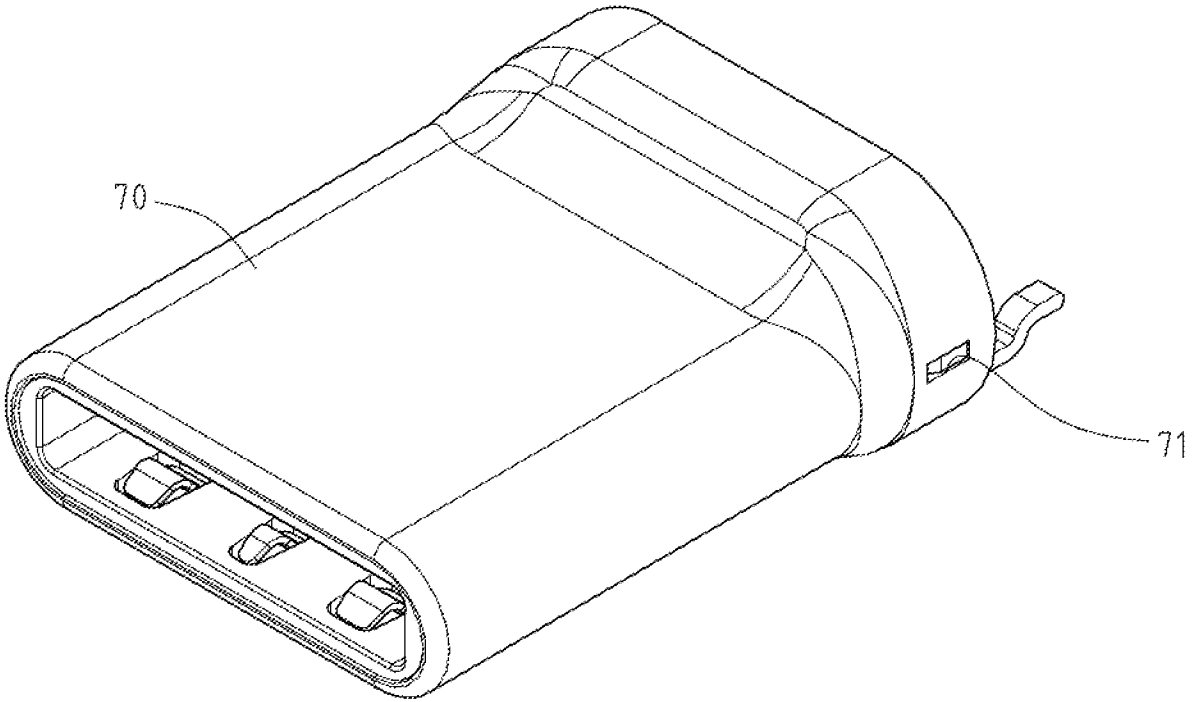
FIG. 1 illustrates a perspective view of an electrical plug connector according to an exemplary embodiment of the instant disclosure.
Figure 2:
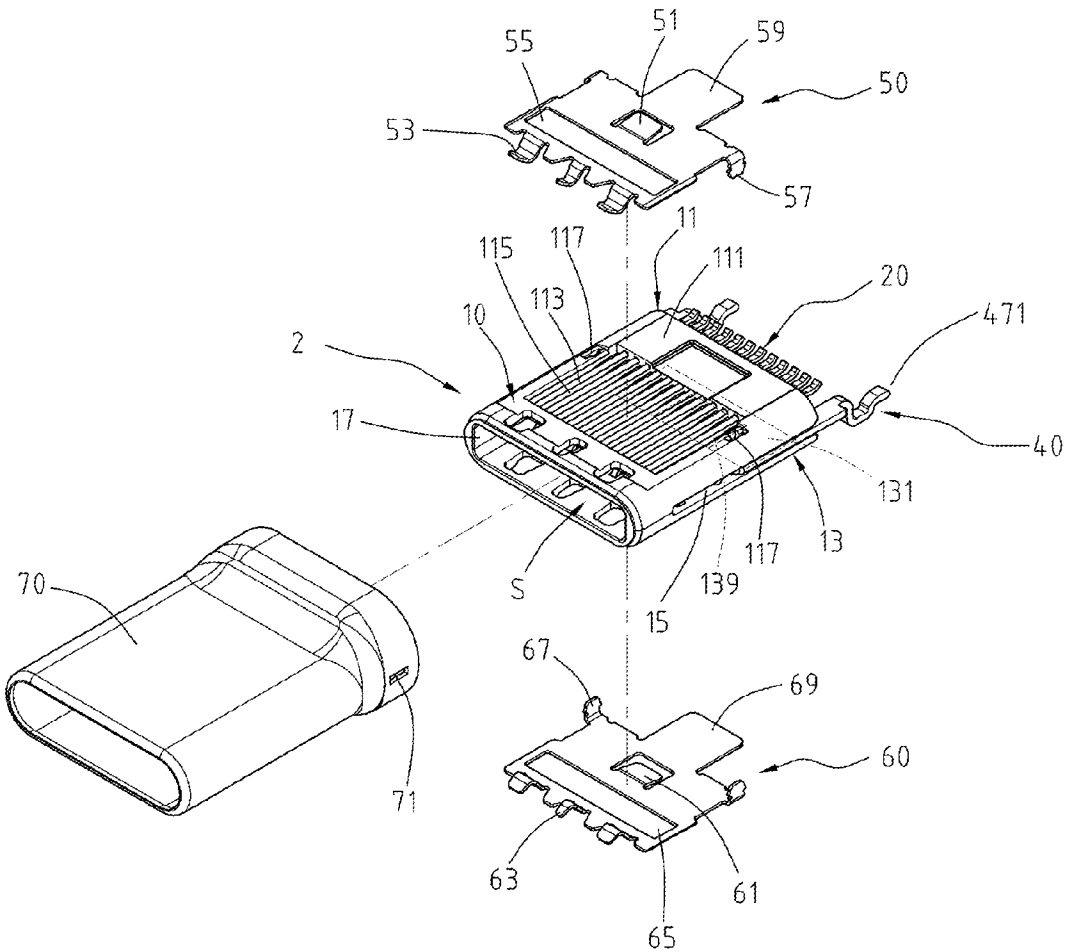
FIG. 2 illustrates an exploded view of the electrical plug connector.
Figure 3:
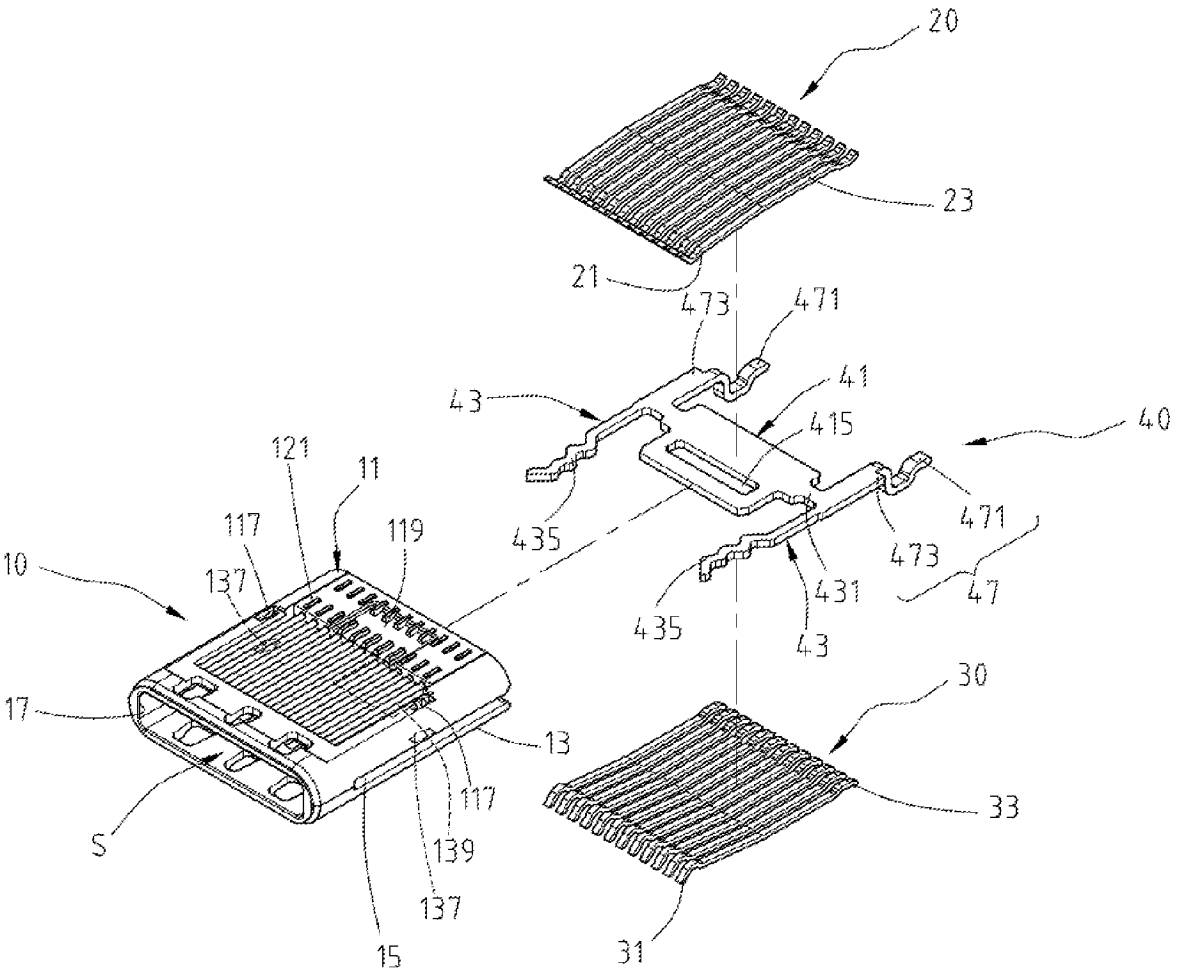
FIG. 3 illustrates a detailed exploded view of the electrical plug connector before the assembly.
Figure 4:
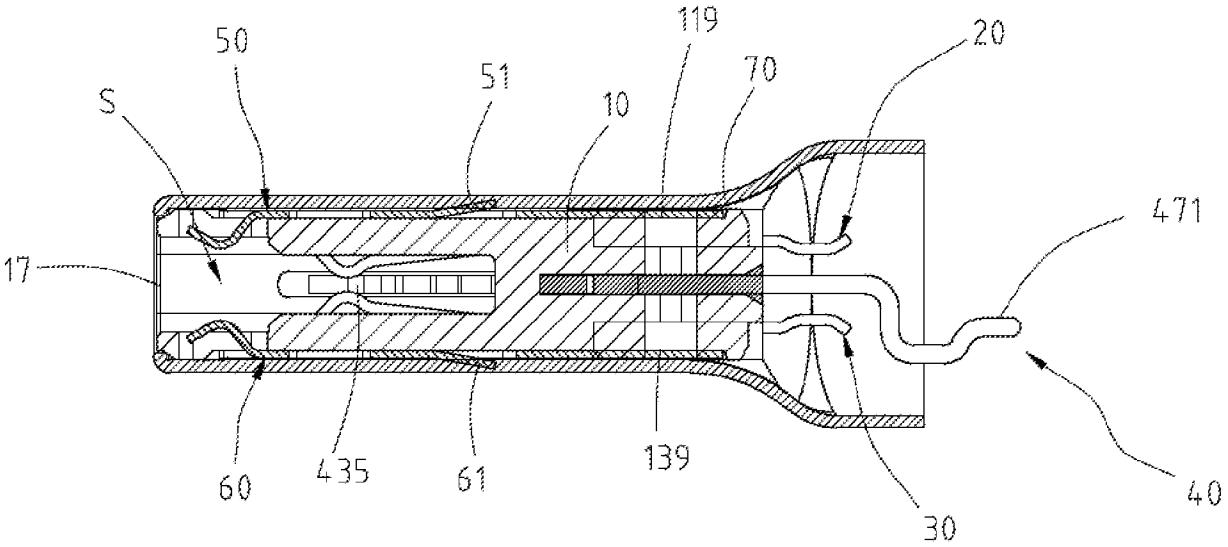
FIG. 4 illustrates a sectional view of the electrical plug connector.

Please refer to FIGS. 1 to 4, which illustrate an electrical plug connector 1 of an exemplary embodiment of the instant disclosure. FIG. 1 illustrates a perspective view of the electrical plug connector 1. FIG. 2 illustrates an exploded view of the electrical plug connector 1. FIG. 3 illustrates a detailed exploded view of the electrical plug connector 1 before the assembly. FIG. 4 illustrates a sectional view of the electrical plug connector 1. As shown in FIGS. 1 to 4, an embodiment of the electrical plug connector 1 comprises an insulated housing 10, a plurality of first terminals 20, a plurality of second terminals 30, a shielding plate 41, and two side arms 43. The shielding plate 41 and the two side arms 43 may be integrally formed with each other to be a shielding connection plate 40 in which a bridge portion 431 is connected between the shielding plate 41 and each of the two side arms 43.

The insulated housing 10 comprises a first assembling surface 11, a second assembling surface 13, an insertion cavity 15, and an insertion opening 17. The first assembling surface 11 is opposite to the second assembling surface 13. The first assembling surface 11 comprises a first hot-melt region 111. The second assembling surface 13 comprises a second hot-melt region 131. The insertion opening 17 is on one of two ends of the insulated housing 10. The first assembling surface 11, the second assembling surface 13, and lateral surfaces of the insulated housing 10 define an insertion space S. The insertion space S is extending from the insertion opening 17 toward an interior of the insulated housing 10, and the insertion cavity 15 is extending from the other end of the insulated housing 10 toward the interior of the insulated housing 10. The insertion cavity 15 is between the first assembling surface 11 and the second assembling surface 13. The cross sectional area of the insertion cavity 15 is less than the cross sectional area of the insertion opening 17. Furthermore, the insertion cavity 15 is extending to the two lateral surfaces of the insulated housing 10 and in communication with the insertion space S.

As shown in FIG. 3, each of the first terminals 20 comprises a first flexible contact portion 21 and a first tail portion 23 extending from one end of the first flexible contact portion 21. The first assembling surface 11 comprises a plurality of protrusions 113 and a plurality of hot-melt blocks 121 corresponding to the protrusions 113. Each of the hot-melt blocks 121 is disposed to one end of the corresponding protrusion 113. A plurality of grooves 115 is defined between the protrusions 113 for positioning the first terminals 20. When the first terminals 20 are disposed on an inner surface of the first assembling surface 11, the hot-melt blocks 121 are melt by heating to form the first hot-melt region 111 as shown in FIG. 2. A portion of each of the first terminals 20 is in the first hot-melt region 111 and positioned by the first hot-melt region 111. The first tail portions 13 are protruding from the insulated housing 10.

Each of the second terminals 20 comprises a second flexible contact portion 31 and a second tail portion 33 extending from one end of the second flexible contact portion 31. The profile of the second terminal 30 may be the same as the profile of the first terminal 20. Similar to the configuration of the first terminals 20, the second terminals 30 are disposed on and positioned with an inner surface of the second assembling surface 13, and the second terminals 13 are in a second hot-melt region 131 that is on the second assembling surface 13. The second tail portions 33 are protruding from the insulated housing 10, and the second tail portions 33 can be soldered with a circuit board by, e.g., SMT (surface mount technology), along with the first tail portions 23.

After the first terminals 20 are disposed to the first assembling surface 11 and the second terminals 30 are disposed to the second assembling surface 13, the shielding connection plate 40 is disposed in the insertion cavity 15, so that the two side arms 43 are respectively located on two ends of the insertion cavity 15. Before the assembly, the first assembling surface 11 comprises a first opening 119, the second assembling surface 13 comprises a second opening 139, and the shielding plate 41 comprises a third opening 415. After the assembly, the first opening 119, the second opening 139, and the third opening 415 are in communication with each other. During the inserting molding procedure, plastic materials or glues are delivered into the first opening 119, the second opening 139, and the third opening 415, so that the shielding plate 41 is molded and positioned with the insulated housing 10. In addition, the first terminals 20 and the second terminals 30 are molded and positioned with the insulated housing 10 to form an insertion module 2 as shown in FIG. 2.

Moreover, as shown in FIGS. 2 to 4, the electrical plug connector 1 further comprises a first conductive sheet 50, a second conductive sheet 60, and an outer shell 70. The first conductive sheet 50 and the second conductive sheet 60 are respectively held on an upper portion and a lower portion of the insulated housing 10 for shielding the first terminals 20 and the second terminals 30. The outer shell 70 is assembled out of the insulated housing 10 for providing further shielding. In addition, the outer shell 70 is a unitary member without assembling. Therefore, the connector can have simplified structure and can be manufactured and assembled conveniently.

In addition, the first conductive sheet 50 comprises a first contact portion 51, and the second conductive sheet 60 comprises a second contact portion 61. The first contact portion 51 and the second contact portion 60 are respectively in contact with the outer shell 70 to form a grounding loop. The first conductive sheet 50 further comprises a plurality of first buckling pieces 53, a first baffle groove 55, a first engaging piece 57, and a first extension portion 59. The second conductive sheet 60 further comprises a plurality of second buckling pieces 63, a second baffle groove 65, a second engaging piece 67, and a second extension portion 69. The profile of the first conductive sheet 50 may be the same as that of the second conductive sheet 60. The first buckling piece 53 and the second buckling piece 63 are for buckling with an electrical receptacle connector when the electrical plug connector 1 is mated with the electrical receptacle connector. The first baffle groove 55 and the second baffle groove 65 prevent the electrical receptacle connector from being impacted by the first conductive sheet 50 or the second conductive sheet 60 when the electrical plug connector 1 is mated with the electrical receptacle connector. The first engaging piece 57 and the second engaging piece 67 allow the first conductive sheet 50 and the second conductive sheet 60 to be assembled with the insulated housing 10. For example, the first engaging piece 57 and the second engaging piece 67 may be respectively assembled with the engaging holes 117, 137 of the insulated housing 10. After the first conductive sheet 50 and the second conductive sheet 60 are assembled on the insulated housing 10, the first extension portion 59 and the second extension portion 69 can be provided for soldering. Therefore, the first conductive sheet 50 and the second conductive sheet 60 can be soldered with the outer shell 70 by laser soldering. Moreover, in one embodiment, as shown in FIG. 2, a free end of the first contact portion 51 and a free end of the first extension portion 59 extend toward a same extending direction, and a free end of the second contact portion 61 and a free end of the second extension portion 69 extend toward a same extending direction.

The two side arms 43 are connected to two ends of the shielding plate 41 and in the insertion cavity 15. The side arms 43 are extending toward the insertion opening 17 for buckling with an electrical receptacle connector M when the electrical plug connector 1 is mated with the electrical receptacle connector M.

Furthermore, the electrical plug connector 1 further comprises two soldering legs 47. The two soldering legs 47 are respectively connected to the two side arms 43. Each of the soldering legs 47 is extending from the corresponding side arm 43 along a direction away from the shielding plate 41 and protruding from the insulated housing 10. The soldering legs 47, the shielding plate 41, and the side arms 43 may be integrally formed with each other. Each of the soldering legs 47 comprises a soldering portion 471, and the soldering portion 471 may be angled with respect to an end portion of the corresponding soldering leg 47 for soldering with a circuit board. Moreover, each of the soldering legs 47 further comprises a contact bump 473. The contact bumps 473 are protruding outward and opposite to each other. After the outer shell 70 is assembled to the insulated housing 10, the contact bumps 473 are in contact with the outer shell 70 and form a grounding loop therebetween. For example, the contact bumps 473 may be engaged with an engaging opening 71 of the outer shell 70 for positioning. Moreover, in one embodiment, as shown in FIGS. 2 and 3, the soldering portions 471 are extending from the respective side arms 43 along a direction away from the respective elastic buckling portion 43, and the contact bumps 473 and the soldering portions 471 of the soldering legs 47 are respectively exposed from two sides of a rear portion of the insulated housing 2.

Figure 5:
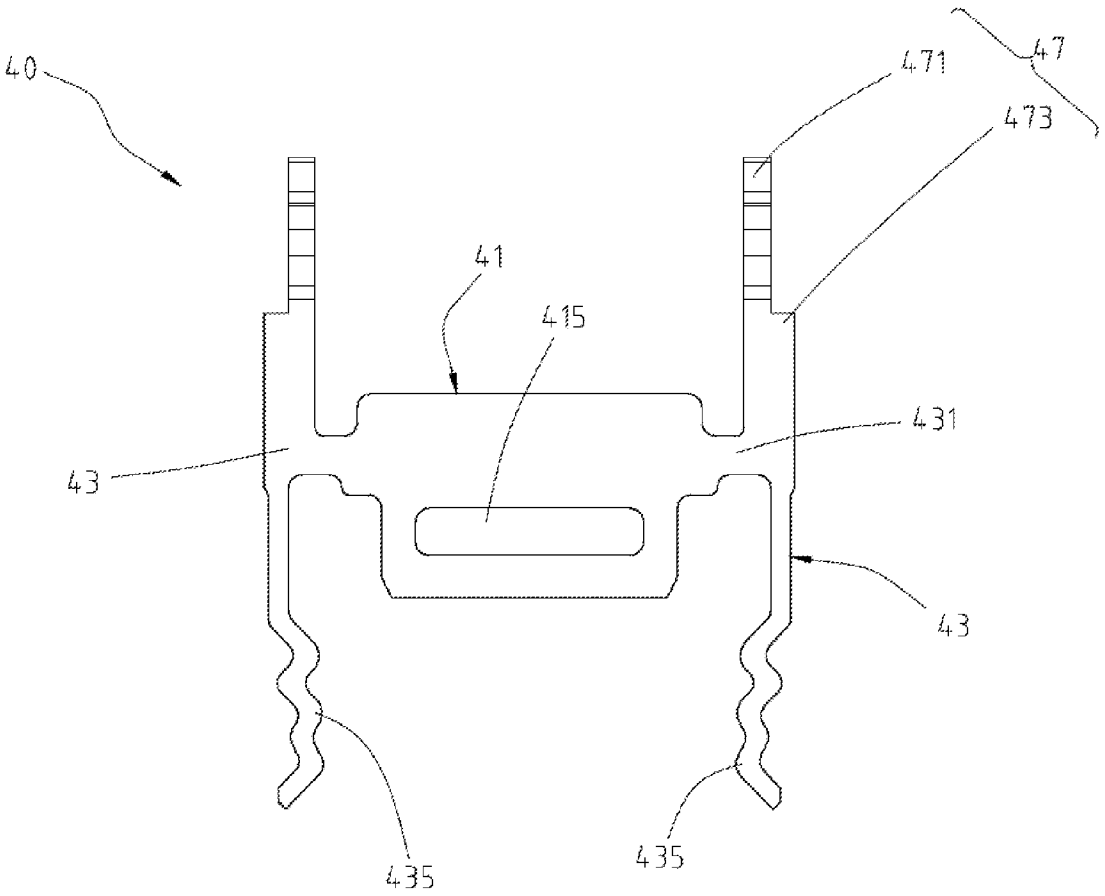
FIG. 5 illustrates a schematic view of one embodiment of side arms of the electrical plug connector.
Figure 6:
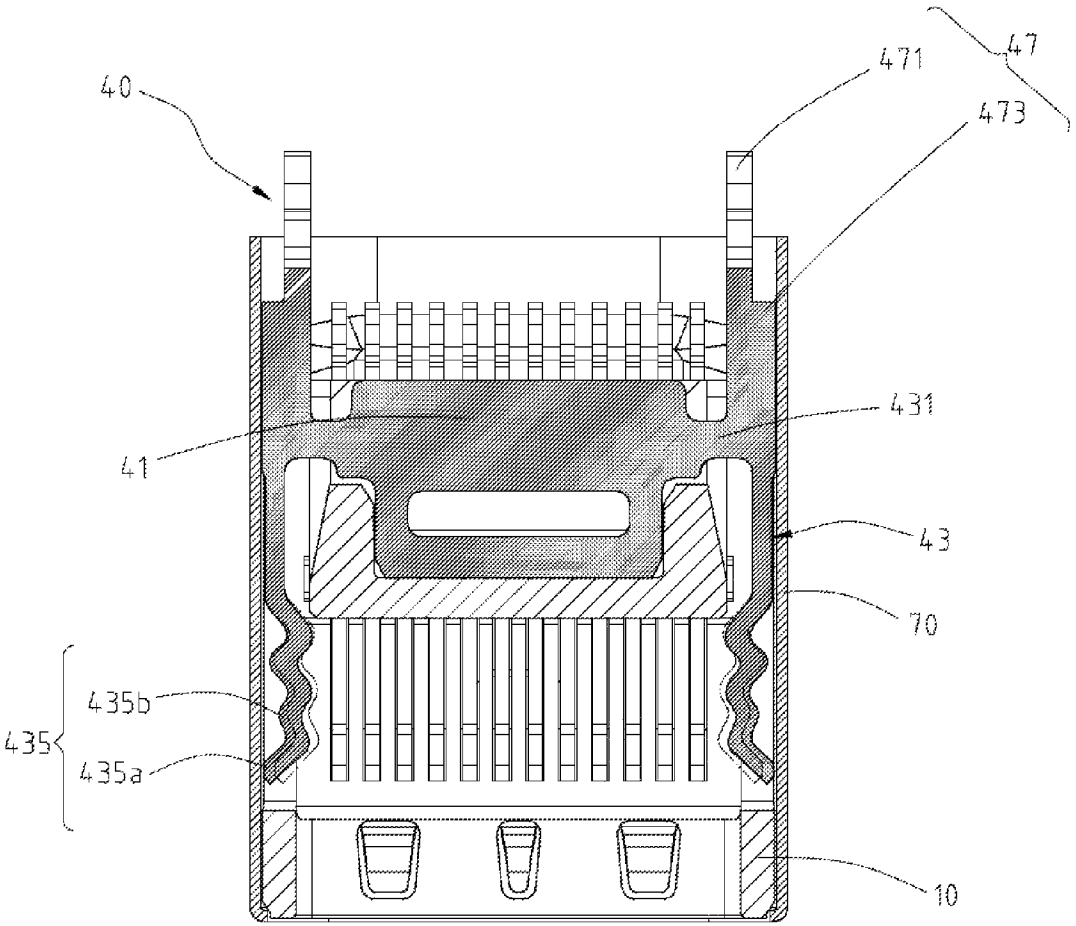
FIG. 6 illustrates an assembled schematic view of one embodiment of the electrical plug connector.

Please refer to FIGS. 5 and 6. FIG. 5 illustrates a schematic view of one embodiment of the side arms 43 of the electrical plug connector 1. FIG. 6 illustrates an assembled schematic view of one embodiment of the electrical plug connector 1. As shown in FIG. 5, each of the side arms 43 comprises an elastic buckling portion 435. The elastic buckling portions 435 face each other for positioning the electrical receptacle connector M. In this embodiment, each of the elastic buckling portions 435 is a wavy shaped structure, and the wavy shaped structures have mirror symmetry. In other words, a first valley of a first wavy shaped structure correspond to a first valley of a second wavy shaped structure, a first peak of the first wavy shaped structure correspond to a first peak of the second wavy shaped structure, and so on. Moreover, in one embodiment, as shown in FIG. 6, the inner wall of the outer shell 70 faces the peaks 435*a* and the valleys 435*b* of the wavy shaped structures.

As shown in FIG. 6, when the electrical plug connector 1 is mated with an electrical receptacle connector M, the elastic buckling portions 435 buckle with the electrical receptacle connector M, so that the side arms 43 are deflected outward. In addition, portions of the elastic buckling portions 435 (e.g., the peaks 435*a* shown in FIG. 6) are in contact with an inner wall of the outer shell 70 to form a grounding loop; on the other hand, portions of the elastic buckling portions 435 (e.g., the valleys 435*b* shown in FIG.

6) are suspended. Accordingly, the elasticity of the side arms 435 can be retained, and the side arms 43 would not be bent or have elastic fatigue when the electrical plug connector 1 is inserted into the electrical receptacle connector M by an excessive insertion force. Moreover, in one embodiment, as shown in FIG. 6, the peaks 435*a* of the wavy shaped structures are to be in contact with the inner wall of the outer shell 70 in a point-contact manner. Additionally, in one embodiment, as shown in FIG. 6, a distance between the peaks 435*a* of the wavy shaped structures is greater than a distance between the valleys 435*b* of the wavy shaped structures.

Figure 7:
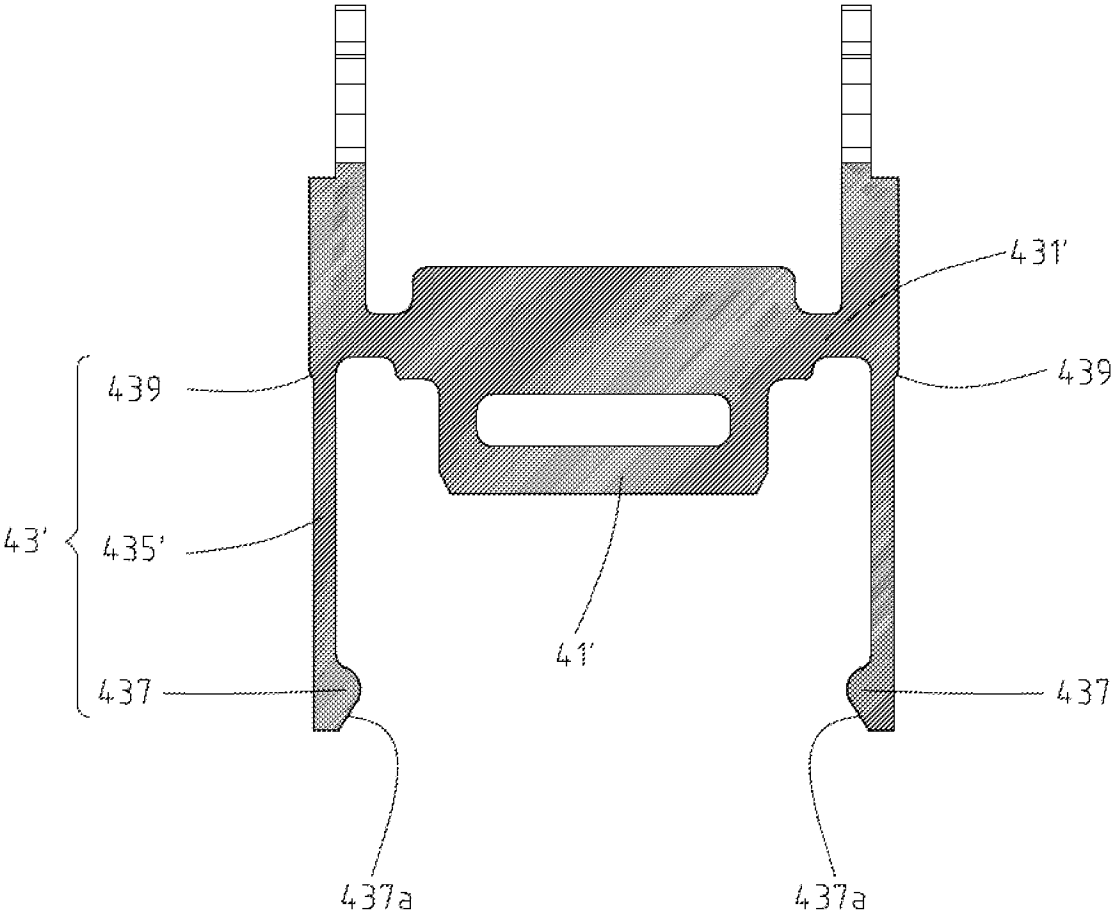
FIG. 7 illustrates a schematic view of another embodiment of the side arms of the electrical plug connector.
Figure 8:
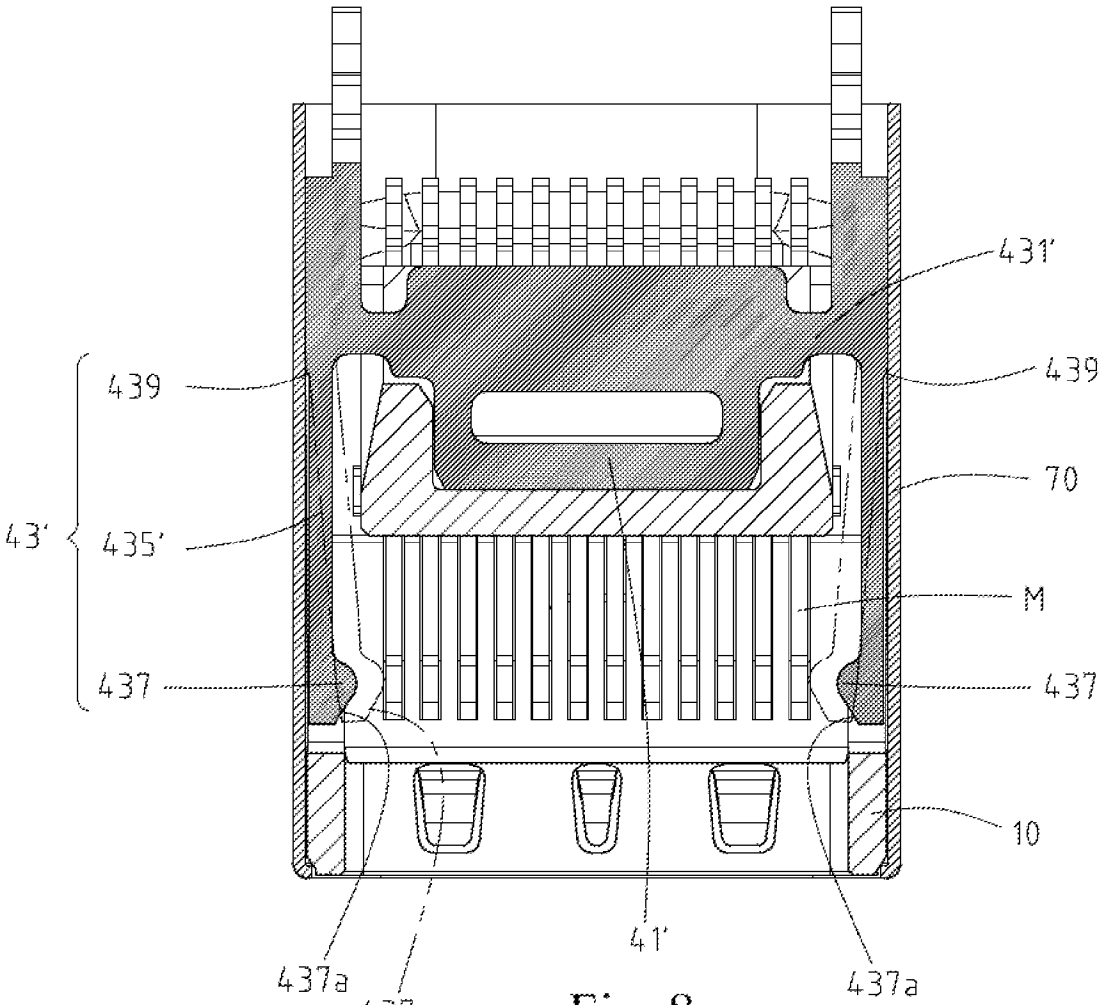
FIG. 8 illustrates an assembled schematic view of another embodiment of the electrical plug connector.

Please refer to FIGS. 7 and 8. FIG. 7 illustrates a schematic view of another embodiment of the side arms 43' of the electrical plug connector 1. FIG. 8 illustrates an assembled schematic view of another embodiment of the electrical plug connector 1. As shown in FIG. 7, in another embodiment, the elastic buckling portion 435' of the side arm 43 comprises a protruding portion 437. The protruding portion 437 has an inclined surface 437*a*. The two inclined surfaces 437*a* of the two side arms 43 form an inverse V shape with respect to an insertion direction of the insertion opening 17. Therefore, when the electrical receptacle connector M is mated with the electrical plug connector 1, the electrical receptacle connector M can be guided by the two side arms 43', so that the electrical receptacle connector M can be mated with the electrical plug connector 1 properly. As shown in FIG. 8, when the electrical plug connector 1 is mated with an electrical receptacle connector M, the protruding portions 437 buckle the electrical receptacle connector M, so that the side arms 43' are deflected outward, and portions of the side arms 43' are in contact with the inner wall of the outer shell 70 to form a grounding loop. Furthermore, the side arms 43' further comprise a recess 439 near to a connecting portion between the side arm 43' and the bridge portion 431', and the recess 439 is located on the outer side of the side arms 43'. Therefore, when the electrical plug connector 1 is mated with an electrical receptacle connector M, portions of the elastic buckling portions 435' are suspended, so that the elasticity of the side arms 43' can be retained.

Based on the above, the shielding plate and the side arms can be assembled with the insertion cavity of the insulated housing. Therefore, the structure of the connector can be simplified, the structural strength of the connector can be improved, the complexity in manufacture and assembly can be reduced, and the defect-free rate of the connector can be improved. Moreover, conventional terminals may be utilized in the connector, therefore, the cost of the mold for the terminals can be saved, and the manufacture cost of the connector can be reduced as well. Furthermore, the connector can perform great electromagnetic shielding performance, and the electromagnetic interference and the signal crosstalk between terminals can be reduced even when the connector is provided for high frequency transmission.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

an insulated housing, comprising a first assembling surface, a second assembling surface, an insertion cavity, and an insertion opening, wherein the first assembling surface comprises a first hot-melt region, the second assembling surface comprises a second hot-melt region, the insertion opening is on one of two ends of the insulated housing, the insertion cavity is extending from an end of the insulated housing opposed to the insertion opening toward an interior of the insulated housing, and the insertion cavity is between the first assembling surface and the second assembling surface;

a plurality of first terminals on an inner surface of the first assembling surface, wherein a portion of each of the first terminals is in the first hot-melt region;

a plurality of second terminals on an inner surface of the second assembling surface, wherein a portion of each of the second terminals is in the second hot-melt region;

a shielding plate in the insertion cavity and fixed with the insulated housing;

two side arms respectively connected to two ends of the shielding plate and on two sides of the insertion cavity, wherein each of the side arms comprises an elastic buckling portion, and the two elastic buckling portions face each other, wherein the elastic buckling portion of each of the side arms is a wavy shaped structure, and the wavy shaped structures of the two side arms have mirror symmetry and correspond to each other, each of the wavy shaped structures has a peak and a valley; and an outer shell, assembled out of the insulated housing, wherein the outer shell having an inner wall corresponding to the insulated housing, the inner wall faces the peaks and the valleys of the wavy shaped structures, wherein, the peaks of the wavy shaped structures are capable of being in contact with the inner wall of the outer shell, and the valleys of the wavy shaped structures are suspended and not capable of being in contact with the inner wall of the outer shell, and wherein the first assembling surface comprises a first opening, the second assembling surface comprises a second opening, the shielding plate comprises a third opening, the first opening and the second opening correspond to the third opening, wherein the first opening, the second opening, and the third opening are in communication with each other.

2. The electrical plug connector according to claim 1, wherein the shielding plate and the two side arms are integrally fanned with each other.

3. The electrical plug connector according to claim 1, wherein the first terminals, the second terminals, the shielding plate, and the side arms are assembled with the insulated housing by inserting molding, and the first opening, the second opening, and the third opening are sealed during the inserting molding.

4. The electrical plug connector according to claim 1, wherein each of the first terminals comprises a first flexible contact portion and a first tail portion extending from one end of the first flexible contact portion, wherein each of the second terminals comprises a second flexible contact portion and a second tail portion extending from one end of the second flexible contact portion, and wherein the first tail portions and the second tail portions are protruding from the insulated housing.

5. The electrical plug connector according to claim 1, further comprising a first conductive sheet and a second conductive sheet respectively held on an upper portion of the insulated housing and a lower portion of the insulated housing, wherein the first conductive sheet and the second conductive sheet are for shielding the first terminals and the second terminals, and wherein the first conductive sheet comprises a first contact portion, the second conductive sheet comprises a second contact portion, and the first contact portion and the second contact portion are respectively in contact with the outer shell.

6. The electrical plug connector according to claim 1, further comprising two soldering legs respectively connected to the side arms, wherein each of the soldering legs is extending from the corresponding side arm along a direction away from the shielding plate and protruding from the insulated housing.

7. The electrical plug connector according to claim 6, wherein each of the soldering legs comprises a contact bump in contact with the outer shell.

8. The electrical plug connector according to claim 1, wherein the first assembling surface and the second assembling surface further comprise a plurality of protrusions, a plurality of grooves is defined between the protrusions for positioning the first terminals and the second terminals, respectively.

9. The electrical plug connector according to claim 1, wherein the peaks of the wavy shaped structures are capable of being in contact with the outer shell in a point-contact manner.

10. The electrical plug connector according to claim 1, wherein a distance between the peaks of the wavy shaped structures is greater than a distance between the valleys of the wavy shaped structures.

11. An electrical plug connector, comprising:

an insulated housing, comprising a first assembling surface, a second assembling surface, an insertion cavity, and an insertion opening, wherein the first assembling surface comprises a first hot-melt region, the second assembling surface comprises a second hot-melt region, the insertion opening is on one of two ends of the insulated housing, the insertion cavity is extending from an end of the insulated housing opposed to the insertion opening toward an interior of the insulated housing, and the insertion cavity is between the first assembling surface and the second assembling surface, the insulated housing further has engaging holes on the first assembling surface and the second assembling surface;

a plurality of first terminals on an inner surface of the first assembling surface, wherein a portion of each of the first terminals is in the first hot-melt region;

a plurality of second terminals on an inner surface of the second assembling surface, wherein a portion of each of the second terminals is in the second hot-melt region;

a shielding plate in the insertion cavity and fixed with the insulated housing;

two side arms respectively connected to two ends of the shielding plate and on two sides of the insertion cavity, wherein each of the side arms comprises an elastic buckling portion, and the two elastic buckling portions face each other;

an outer shell, assembled out of the insulated housing; and a first conductive sheet and a second conductive sheet respectively held on an upper portion of the insulated housing and a lower portion of the insulated housing, wherein the first conductive sheet and the second conductive sheet are for shielding the first terminals and the second terminals, and wherein the first conductive sheet comprises a first contact portion, the second conductive sheet comprises a second contact portion, the first contact portion and the second contact portion are respectively in contact with the outer shell, the first conductive sheet further comprises a first engaging piece, the second conductive sheet further comprises a second engaging piece, the first engaging piece and the second engaging piece are respectively assembled with the engaging holes of the insulated housing, wherein the first assembling surface comprises a first opening, the second assembling surface comprises a second opening, the shielding plate comprises a third opening, the first opening and the second opening correspond to the third opening, wherein the first opening, the second opening, and the third opening are in communication with each other.

12. The electrical plug connector according to claim 11, wherein the shielding plate and the two side arms are integrally formed with each other.

13. The electrical plug connector according to claim 11, wherein the first terminals, the second terminals, the shielding plate, and the side arms are assembled with the insulated housing by inserting molding, and the first opening, the second opening, and the third opening are sealed during the inserting molding.

14. The electrical plug connector according to claim 11, wherein each of the first terminals comprises a first flexible contact portion and a first tail portion extending from one end of the first flexible contact portion, wherein each of the second terminals comprises a second flexible contact portion and a second tail portion extending from one end of the second flexible contact portion, and wherein the first tail portions and the second tail portions are protruding from the insulated housing.

15. The electrical plug connector according to claim 11, further comprising two soldering legs respectively connected to the side arms, wherein each of the soldering legs is extending from the corresponding side arm along a direction away from the shielding plate and protruding from the insulated housing.

16. The electrical plug connector according to claim 15, wherein each of the soldering legs comprises a contact bump in contact with the outer shell.

17. The electrical plug connector according to claim 11, wherein the first assembling surface and the second assembling surface further comprise a plurality of protrusions, a plurality of grooves is defined between the protrusions for positioning the first terminals and the second terminals, respectively.

18. The electrical plug connector according to claim 11, wherein the elastic buckling portion of each of the side arms is a wavy shaped structure, and the wavy shaped structures of the two side arms have mirror symmetry and correspond to each other.

19. The electrical plug connector according to claim 11, wherein the elastic buckling portion of each of the side arms comprises a protruding portion, the protruding portion has an inclined surface, and the two inclined surfaces of the two side arms form an inverse V shape with respect to an insertion direction of the insertion opening.

20. The electrical plug connector according to claim 11, wherein the first conductive sheet further comprises a first extension portion, the second conductive sheet further comprises a second extension portion, the first extension portion and the second extension portion are for soldering with the outer shell, a free end of the first contact portion and a free end of the first extension portion extend toward a same extending direction, and a free end of the second contact portion and a free end of the second extension portion extend toward a same extending direction.

21. An electrical plug connector, comprising:

an insulated housing, comprising a first assembling surface, a second assembling surface, an insertion cavity, and an insertion opening, wherein the first assembling surface comprises a first hot-melt region, the second assembling surface comprises a second hot-melt region, the insertion opening is on one of two ends of the insulated housing, the insertion cavity is extending from an end of the insulated housing opposed to the insertion opening toward an interior of the insulated housing, and the insertion cavity is between the first assembling surface and the second assembling surface;

a plurality of first terminals on an inner surface of the first assembling surface, wherein a portion of each of the first terminals is in the first hot-melt region;

a plurality of second terminals on an inner surface of the second assembling surface, wherein a portion of each of the second terminals is in the second hot-melt region;

a shielding plate in the insertion cavity and fixed with the insulated housing;

two side arms respectively connected to two ends of the shielding plate and on two sides of the insertion cavity, wherein each of the side arms comprises an elastic buckling portion, and the two elastic buckling portions face each other;

an outer shell, assembled out of the insulated housing, wherein the outer shell has engaging openings; and two soldering legs respectively connected to the side arms, wherein each of the soldering legs is extending from the corresponding side arm along a direction away from the shielding plate and protruding from the insulated housing, each of the soldering legs comprises a contact bump, the contact bumps are protruding outward and opposite to each other, the contact bumps are engaged with the engaging openings.

22. The electrical plug connector according to claim 21, wherein the shielding plate and the two side arms are integrally formed with each other.

23. The electrical plug connector according to claim 21, wherein the first assembling surface comprises a first opening, the second assembling surface comprises a second opening, the shielding plate comprises a third opening, the first opening and the second opening correspond to the third opening, wherein the first opening, the second opening, and the third opening are in communication with each other.

24. The electrical plug connector according to claim 23, wherein the first terminals, the second terminals, the shielding plate, and the side arms are assembled with the insulated housing by inserting molding, and the first opening, the second opening, and the third opening are sealed during the inserting molding.

25. The electrical plug connector according to claim 21, wherein each of the first terminals comprises a first flexible contact portion and a first tail portion extending from one end of the first flexible contact portion, wherein each of the second terminals comprises a second flexible contact portion and a second tail portion extending from one end of the second flexible contact portion, and wherein the first tail portions and the second tail portions are protruding from the insulated housing.

26. The electrical plug connector according to claim 21, further comprising a first conductive sheet and a second conductive sheet respectively held on an upper portion of the insulated housing and a lower portion of the insulated housing, wherein the first conductive sheet and the second conductive sheet are for shielding the first terminals and the second terminals, and wherein the first conductive sheet comprises a first contact portion, the second conductive sheet comprises a second contact portion, and the first contact portion and the second contact portion are respectively in contact with the outer shell.

27. The electrical plug connector according to claim 21, wherein the first assembling surface and the second assembling surface further comprise a plurality of protrusions, a plurality of grooves is defined between the protrusions for positioning the first terminals and the second terminals, respectively.

28. The electrical plug connector according to claim 21, wherein the elastic buckling portion of each of the side arms is a wavy shaped structure, and the wavy shaped structures of the two side arms have mirror symmetry and correspond to each other.

29. The electrical plug connector according to claim 21, wherein the elastic buckling portion of each of the side arms comprises a protruding portion, the protruding portion has an inclined surface, and the two inclined surfaces of the two side arms form an inverse V shape with respect to an insertion direction of the insertion opening.

30. The electrical plug connector according to claim 21, wherein each of the soldering legs further comprises a soldering portion extending from the corresponding side arm along a direction away from the corresponding elastic buckling portion, the contact bumps and the soldering portions of the soldering legs are respectively exposed from two sides of a rear portion of the insulated housing.

* * * * *